United States Patent [19]

Gaudio

[11] Patent Number: 4,804,942

[45] Date of Patent: Feb. 14, 1989

[54] VERIFYING AUTOMATIC LINE INTEGRITY DIAGNOSTIC (V.A.L.I.D.) APPARATUS AND METHODS FOR INTRUSION DETECTION SYSTEMS

[75] Inventor: Raymond Gaudio, Babylon, N.Y.

[73] Assignee: Napco Security Systems, Inc., Copiague, N.Y.

[21] Appl. No.: 123,909

[22] Filed: Nov. 23, 1987

[51] Int. Cl.[4] ..... G08B 29/00

[52] U.S. Cl. ..... 340/514; 340/506; 340/507; 340/508; 340/511

[58] Field of Search ..... 340/514, 527, 528, 500, 340/506–511, 537

[56] References Cited

U.S. PATENT DOCUMENTS

| | | | |
|---|---|---|---|
| 4,523,183 | 6/1985 | Frick | 340/507 |
| 4,651,138 | 3/1987 | Morrison | 340/511 |
| 4,751,498 | 6/1988 | Shalvi et al. | 340/508 |

*Primary Examiner*—Donnie L. Crosland

*Attorney, Agent, or Firm*—Arthur L. Plevy

[57] ABSTRACT

An intrusion detection loop employing an end-of-line resistor that operates with a voltage window. As the voltage window is increased, the sensitivity of the system decreases. As the window is decreased, the sensitivity of the system increases. By utilizing two comparators each having one input coupled to the loop, one can specify one voltage window when the system is disarmed and hence place the system at maximum sensitivity thereby detecting any borderline problem. In any event, the same two comparators operate to provide a different voltage window when the system is armed and hence desensitizing the loop and therefore reducing alarm probability. In this manner one can determine during the disarmed condition that the loop is operating with a borderline resistance and still employ the system in the armed condition to assure that there will be a reduced alarm probability in view of an undesirable change of the loop resistance.

10 Claims, 1 Drawing Sheet

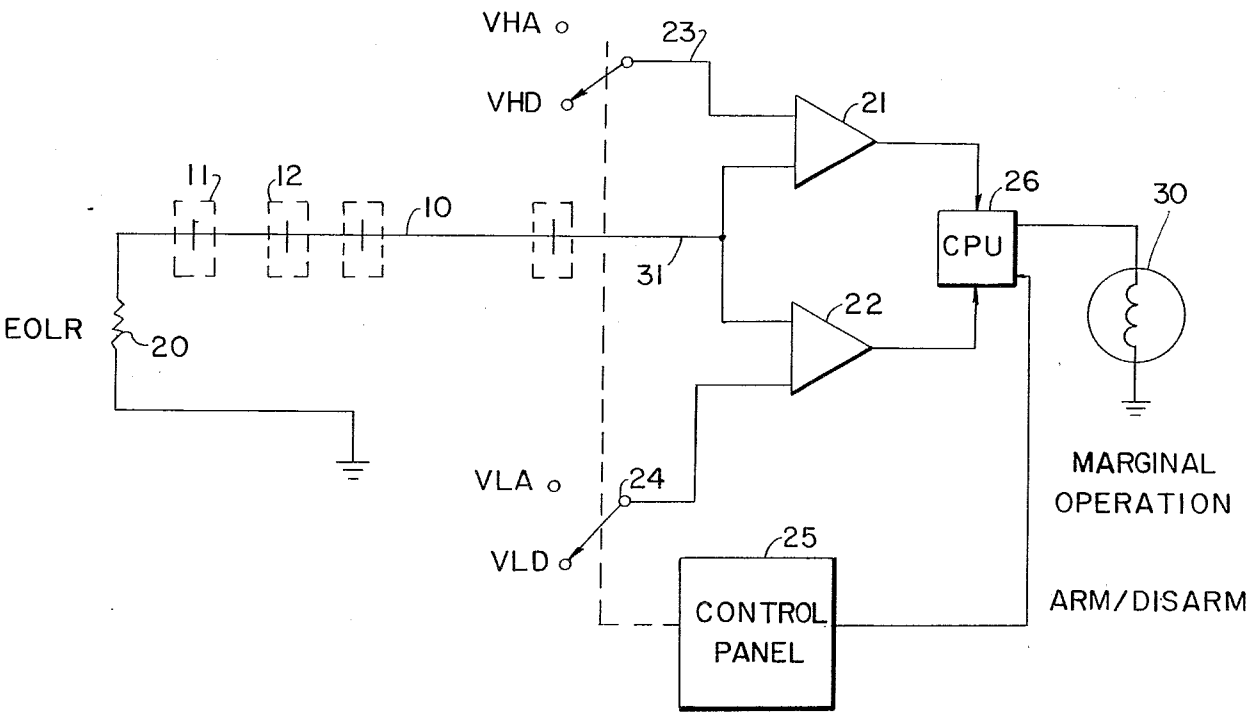
30
MARGINAL OPERATION
ARM/DISARM
26
CPU
21
22
25
CONTROL PANEL
23
31
24
VHA
VHD
VLA
VLD
10
12
11
20
EOLR

VERIFYING AUTOMATIC LINE INTEGRITY DIAGNOSTIC (V.A.L.I.D.) APPARATUS AND METHODS FOR INTRUSION DETECTION SYSTEMS

BACKGROUND OF THE INVENTION

This invention relates to intrusion detection systems in general and more particularly to such systems employing a continuous loop of sensing devices and apparatus for assuring proper operating conditions of said loop.

The prior art is replete with a number of intrusion detection systems which employ a plurality of sensors in a closed loop. Each of the sensors in the loop operates to monitor a particular location or a particular area such as a window, door or other area. Essentially, the sensors consist of closed contacts which indicate that the premises being monitored are secured. As soon as a door or window is opened or some other intrusion occurs on the monitored area or zones, the sensor operates to open, thus providing an opened circuit.

Since a plurality of sensors are wired in a loop, an open circuit indicates the presence of an alarm. In any event, modern intrusion detection systems employ threshold monitoring circuits. Such circuitry exists to determine that there is a valid alarm condition rather than a spurious or transient condition. In any event, such systems experience operating changes due to aging, temperature and other environmental conditions. These changes can result in false alarms when the system is armed or operative to monitor a zone for intrusion. In spite of many advances made in security systems, the present invention operates to monitor the resistance of the loop both in an armed and disarmed mode. In this manner by adequately monitoring the resistance of the loop, the system logic can be sure that the loop is operating correctly and there will be no problem when the system is switched from an armed to a disarmed condition or vice versa.

It is a objective of many intrusion detection systems to provide an open circuit indication to the control panel when the system is disarmed and not operating to monitor a given zone or a plurality of zones. When the system is armed, the loop presents a finite impedance to the control panel which therefore can make an accurate determination as to whether or not a zone has been violated or intruded upon. It is, of course, understood that based on modern components and based on the sensing devices utilized such as switches and so on, the resistance of such devices changes over periods of time. Hence due to corrosion, temperature, humidity and other environmental changes, the absolute resistance of the loop can change on a daily basis and actually change substantially on a long-term basis.

In a loop which has been operating for long periods of time one can experience extreme changes in resistance such that the entire monitoring system becomes extremely unreliable and thereby is capable of indicating an alarm condition when no such condition exists.

It is an object of the present invention to monitor an intrusion detection system loop to determine whether or not the loop will be operating reliably between an armed and disarmed condition.

It is a further object of the present invention to provide a reliable detection system capable of operating with an intrusion detection loop to determine whether or not the loop has proper resistance when operated from a disarmed state to an armed state. Essentially, as one can ascertain, the prior art is replete with a number of devices which operate to monitor the resistance or continuity of a particular line or circuit.

For example, reference is made to U.S. Pat. No. 3,551,797 issued on Dec. 29, 1970 to J. D. Holder et al and entitled AUDIO OUTPUT DEVICE FOR TESTING LEAKAGE AND CONTINUITY OF THE CIRCUIT. This patent discloses a leakage and continuity circuit which includes two monitors for testing an attached line. There are two terminals which are used for continuity to detect a break in the lines. These terminals are used for the leakage test and namely, to detect the particular current flow in the line.

U.S. Pat. No. 3,284,707 issued on Nov. 8, 1966 to H. H. Clinton and entitled CIRCUIT CONTINUITY AND RESISTANCE TESTER HAVING AN AUDIBLE OUTPUT SIGNAL. This patent discloses a circuit for testing an attached circuit in a high or low resistance mode based on a position of a high/low switch.

U.S. Pat. No. 4,594,542 issued Jun. 10, 1986 to F. H. Fish and is entitled SOLID STATE HIGH/LOW RESISTANCE MONITOR. This patent shows a resistance monitoring circuit having high and low selectable ratios which are implemented by means of a switch.

In any event, as indicated, there are many patents which rely on two-mode testing arrangements. However, none of these patents are adaptable or relate to intrusion detection systems nor do any of the patents operate to solve the above-noted problems which are substantial problems in the reliable operation of intrusion detections systems.

Thus as will be explained, it is a primary object of the present invention to provide a system and method for verifying automatic line integrity and employed as a diagnostic for indicating whether or not an intrusion detection loop is operating under proper conditions and will operate to reliably indicate proper alarm condition.

BRIEF DESCRIPTION OF THE PREFERRED EMBODIMENT

A method of operating an end of line resistor loop in an intrusion detection system to provide a first sensitivity during an armed mode and a second sensitivity during a disarmed mode, comprising the steps of providing a first voltage window indicative of increased system sensitivity when said intrusion detection system is disarmed, providing a second voltage window indicative of a decreased system sensitivity when said intrusion detection system is armed, providing an output indication during said disarmed condition indicative of a probable false alarm indication being provided in said armed condition which indication is further reduced due to said decreased sensitivity.

BRIEF DESCRIPTION OF THE FIGURES

The FIGURE is the sole schematic of an intrusion detection system employing a loop having an end of line resistance and employing comparators according to the invention herein 10.

DETAILED DESCRIPTION OF THE FIGURES

Referring to the sole FIGURE, there is shown an intrusion detection loop.

Essentially, the intrusion detection loop 10 comprises a given end of line resistor 20 which essentially is indicative of the overall resistance of the loop 10. As indicated above, the loop consists of a plurality of sensor devices as 11 or 12, each of which serve to monitor a particular zone or area associated with the premises being monitored. The sensors as 11 or 12 may be vibration sensors, switches which are placed on windows, foil or other devices.

As one can ascertain, when the loop is totally secured and all windows, doors and other exits and items are secured, the sensors provide a closed circuit which circuit is manifested by an end of line resistance 20 and is returned to ground. The loop is conventionally monitored by means of a control panel and associated circuitry 25 which may have included therein a microprocessor or CPU unit 26. As seen in the schematic, one side 31 of the loop is coupled respectively to inputs of comparators 21 and 22. The comparators 21 and 22 are conventional components having their outputs coupled to the CPU 26 or other logic circuit. As one can further ascertain, the other input of each comparator is coupled respectively through a ganged switch as switches 23 and 24. In a first position as shown, the switches are positioned in a disarm (D) mode or state. The switch 23 is coupled to a first reference voltage designated as VHD which stands for "V high disarmed" while switch 24 is coupled to another reference voltage designated VLD which is "V low disarmed". As one can ascertain, when the switches are placed in the upward position then the reference voltage to each comparator 21 and 22 changes as for example switch 23 will be connected to terminal designated as VHA which is "V high armed" while switch 24 will be connected to terminal designated as VLA which is "V low armed". In this manner the switches serve to provide a voltage window which essentially is determined by a high and a low voltage for both the arm/disarm condition. Therefore, there is a certain window or sensitivity associate with the disarmed condition which is a greater sensitivity and hence a more narrow window then the system will implement during an armed condition where the voltage window would be wider and indicative of a lower sensitivity.

As one can ascertain, the theory and method of the present invention indicates that the end of the line resistor loop 20 operates with the voltage window. As the window is increased, the sensitivity of the system decreases. As the window is decreased, the sensitivity of the system increases. Thus as one can determine from the figure, when the system is in the disarm condition, the sensitivity of the system is greater as there is a narrow voltage window. Hence VHD is closer to VLD. In this manner during the disarm condition, if the line resistor is such that the resistance substantially increases due to corrosion of terminals or for other reasons, the comparators 21 and 22 via the CPU 26 will indicate this condition to the control panel user via the indicator 30.

Hence the system will indicate that during a disarm condition and based on the narrow voltage window, the system is unreliable and therefore could probably cause a false alarm when the system is placed in the armed condition or during an arming mode. In any event, when switches 23 or 24 are placed in the armed condition (A), the voltage window is wider. Due to the fact that the voltage window is wider, the system becomes less sensitive but is still capable of indicating a valid alarm. It is, of course, understood that the outputs of the comparators 21 and 22 are monitored by a CPU or other logic element 26 which operates within the bounds and constraints of the windows provided during the armed and disarmed states. The difference in width of the voltage windows in the armed and disarmed state may be between 1.1 to 1.5 times.

As one can ascertain, the control panel 25 which is part and parcel of the system logic and which contains the CPU 26 is responsive to the positions of switches 23 and 24 indicative of the system being in an armed or disarmed condition. This information, of course, is sent to the CPU which then monitors the outputs of comparators 21 and 22 accordingly.

Since as indicated above, there is a greater sensitivity when the system is in the.disarmed position, the comparators 21 and 22 will produce an output if the resistance of the loop for example increases substantially. This output will indicate that there will be difficulties and the system is in a marginal mode and may operate to produce a great number of false alarms when placed in the armed condition. In any event, this will inform the system user that all sensor terminals as 11 or 12 as well as various other sensors should be checked for true resistance in order to place the system back in a reliable operating condition.

Since the voltage window will be increased for the armed condition, the fact that the system is in a sensitive or marginal mode of operation will not affect its overall ability to detect valid intrusions. Hence as one can ascertain when the system, as described above is disarmed, the end of the system will be at maximum sensitivity thereby detecting any borderline problems. In any event, since the system is desensitized during the arming condition, the above-described apparatus automatically serves to reduce false alarm probability.

Hence the above-noted apparatus serves a dual function of detecting borderline systems operation during a disarmed condition and further assures that the number of false alarms will be at a minimum due to the decreased sensitivity when in the armed mode.

I claim:

1. A method of operating an end of line resistor loop in an intrusion detection system to provide a first sensitivity during an armed mode and a second sensitivity during a disarmed mode, comprising the steps of:

providing a first voltage window indicative of increased system sensitivity when said intrusion detection system is disarmed, providing a second voltage window indicative of a decreased system sensitivity when said intrusion detection system is armed, providing an output indication during said disarmed condition indicative of a probable false alarm indication being provided in said armed condition which indication is further reduced due to said decreased sensitivity.

2. The method according to claim 1, wherein the step of providing first and second voltage window, includes, connecting one input of a first and a second comparator to said loop, and connecting the other input of said comparators to the suitable arm of a disarm/-arm switch to provide first reference levels to each of said comparators during said disarmed condition and second levels during said armed condition whereby s id first levels provide said first voltage window and said second levels provide said second voltage window.

3. The method according to claim 2, wherein the step of providing an output indication includes the step of monitoring the outputs of said first and second comparators during said armed condition to provide said indication.

4. The method according to claim 1, wherein said intrusion detection system includes control panel means operative to provide an indication at an output indicative of said system armed or disarmed mode.

5. Apparatus for operating an end of line resistor loop in an intrusion detection systems, said loop comprising a plurality of interconnected intrusion sensors arranged in a series loop which loop is closed when said sensors exhibit a low impedance state indicative of a non-intrusion mode, with said system operative in an armed state to monitor a change in said low impedance state indicative of an intrusion and in a disarmed state where an intrusion condition is not monitored, comprising:

comparator means coupled to said loop and operative to provide a first sensitivity during said disarmed state and operative to provide a second sensitivity during said armed state with said first sensitivity being greater than said second to thereby generate an indication during said disarmed state indicative of a marginal operating mode for said armed state, with said marginal mode discriminated against during said armed state due to said lower sensitivity.

6. The apparatus according to claim 5, wherein said comparator means includes, a first comparator having one input coupled to said loop and one input coupled to the switchable arm of a first arm/disarm switch to provide to said comparator a first reference level during said armed state and a second reference level during said disarmed state, a second comparator having one input coupled to said loop and one input coupled to the switchable arm of a second arm/disarm switch to provide to said second comparator a third reference level during said armed state and a fourth reference level during said disarmed state, with said first and third reference level providing a first voltage window during said armed state indicative of a decreased system sensitivity and with said second and fourth reference levels providing a second voltage window during said disarmed state indicative of an increased system sensitivity.

7. The apparatus according to claim 6, further including logic means coupled to the outputs of said first and second comparators and operative to provide a first output signal indicative of a intrusion in said armed state and a second output signal indicative of a marginal system condition in said disarmed state.

8. The apparatus according to claim 7, further including means coupled to said logic means and operative to provide an indication of said second output signal to serve as a warning of possible marginal operating conditions during said disarmed state.

9. The apparatus according to claim 6, wherein said first voltage window is 1.1–1.5 times wider than said second voltage window.

10. The apparatus according to claim 5, wherein said intrusion sensors are of the type providing a low impedance for a non-intrusion state and a high impedance for an intrusion state as a low impedance for a closed portal and a high impedance for an opened portal.

* * * * *